US005845661A

United States Patent [19]

Leppo

[11] Patent Number: 5,845,661

[45] Date of Patent: Dec. 8, 1998

[54] PARTS WASHER

[75] Inventor: Allen W. Leppo, Hanover, Pa.

[73] Assignee: R. H. Sheppard Co., Inc., Hanover, Pa.

[21] Appl. No.: 878,086

[22] Filed: Jun. 18, 1997

[51] Int. Cl.[6] ..... B08B 3/04

[52] U.S. Cl. ..... 134/89; 134/90; 134/91; 134/102.2; 134/104.4; 134/105; 134/135

[58] Field of Search ..... 134/88, 89, 90, 134/91, 102.1, 102.2, 104.4, 105, 107, 135

[56] References Cited

U.S. PATENT DOCUMENTS

| | | | |
|---|---|---|---|
| 395,393 | 1/1889 | Holzmark . | |
| 934,331 | 9/1909 | Merrill . | |
| 1,668,923 | 5/1928 | Rymann | 134/89 X |
| 1,752,137 | 3/1930 | Ahearn . | |
| 2,764,171 | 9/1956 | Nolte | 134/107 X |
| 3,028,267 | 4/1962 | Edhofer et al. | 134/7 |
| 3,229,702 | 1/1966 | Murdoch, Jr. | 134/89 |
| 3,343,555 | 9/1967 | Kasner | 134/111 |
| 3,414,249 | 12/1968 | Mescher et al. | 266/6 |
| 3,476,126 | 11/1969 | Pinkham | 134/60 |
| 3,531,323 | 9/1970 | Carpenter et al. | 134/89 X |
| 3,854,445 | 12/1974 | Stolle et al. | 118/62 |
| 3,910,297 | 10/1975 | Pinkham | 134/76 |
| 4,170,240 | 10/1979 | Gentry | 134/57 R |
| 4,375,992 | 3/1983 | Stevens et al. | 134/25.4 |
| 4,421,130 | 12/1983 | Kataishi et al. | 134/76 |
| 4,440,185 | 4/1984 | Wiltse | 134/104.4 |
| 4,451,298 | 5/1984 | Yagishita et al. | 134/10 |
| 4,561,144 | 12/1985 | Marais | 154/302 |
| 4,651,762 | 3/1987 | Bowden | 134/111 |
| 4,772,357 | 9/1988 | Carlson et al. | 156/626 |
| 4,886,082 | 12/1989 | Kato et al. | 134/60 |
| 5,090,430 | 2/1992 | Nixon | 134/84 |
| 5,277,208 | 1/1994 | Mansur | 134/107 X |
| 5,303,725 | 4/1994 | Hilgren | 134/104.4 X |
| 5,322,078 | 6/1994 | Tuttle | 134/104.4 |
| 5,333,629 | 8/1994 | Higashino | 134/76 |
| 5,341,825 | 8/1994 | Kobayashi | 134/61 |
| 5,402,806 | 4/1995 | Hakeem et al. | 134/60 |
| 5,421,883 | 6/1995 | Bowden | 118/73 |
| 5,501,240 | 3/1996 | Dohku et al. | 134/61 |
| 5,520,204 | 5/1996 | Bodis | 134/61 |

FOREIGN PATENT DOCUMENTS

| | | | |
|---|---|---|---|
| 68952 | 5/1914 | Switzerland | 134/91 |

*Primary Examiner*—Philip R. Coe
*Attorney, Agent, or Firm*—Thomas Hooker, P.C.

[57] ABSTRACT

A parts washer for removing cutting oil from machined parts includes two open compartments separated by a common heat-conducting wall. A single heater in one compartment heats washing solution in both compartments. The back of the washer has a stepped configuration to protect components from injury while the washer is on the shop floor.

20 Claims, 5 Drawing Sheets

PARTS WASHER

FIELD OF THE INVENTION

The present invention relates to parts washers for removing cutting oil from machined parts.

BACKGROUND OF THE INVENTION

Milling and boring machines are used to shape machine parts to required specifications. When milling and boring, it is necessary to lubricate the part with cutting oil. The oil coats and adheres to the machined part.

Once the machining is completed, the cutting oil must be removed from the part. This can be accomplished by use of a degreasing compound specifically designed to remove oil. Naphtha is commonly used to remove cutting oil. Removal of the oil exposes the machined surfaces to air which may result in unwanted rust. The cleaned part is conventionally coated with a rust inhibitor to prevent machined surfaces from rusting.

Cutting oil is conventionally removed in two steps. First, the degreasing compound, conventionally naphtha, is applied to the part and then removed. Second, the rust inhibitor is applied to the part. This two step operation is costly and time-consuming.

Additionally, care must be taken in disposal of the degreasing compound. Naphtha is not environmentally safe. The used compound must be disposed of in accordance with environmental regulations. Environmental regulations require reduction in the use of naphtha for all manufacturing facilities and can prevent use of naphtha to remove oil from machined parts.

SUMMARY OF THE INVENTION

The invention is a moveable parts washer that includes a pair of side by side open wash compartments in an outer enclosure. The compartments are adjacent to each other and are separated by a common heat-transmitting center wall. A single heater heats cleaning solution in both compartments. The cleaning solution in both compartments is composed of water, an oil-removing soap, and a rust inhibitor. Two storage tanks are located below the compartments, a cleaning solution storage tank and a waste tank. The cleaning solution tank is located above the storage tank to facilitate drawing solution from the tank to replenish solution in the compartments.

Parts are manually washed by submerging them in heated solution in a first compartment, rubbing or scrubbing the parts to remove cutting oil, and then submerging and further washing the part in the heated solution in a second compartment. Two washes insure all cutting oil is effectively removed. After the part has been washed twice, it is removed from the second compartment and placed on a rack extending across the compartments for drying. Solution on the cleaned part drains back into the compartments.

The enclosure is supported on rollers to facilitate easy movement of the washer about a work facility. A step-like tank profile extends rearwardly beyond the compartments to prevent accidental damage to controls and other parts of the washer.

Cutting oil washed from parts collects on the top of the cleaning solution in the compartments and is removed by skimmers. The collected waste oil drains to the waste tank at the bottom of the enclosure. At a convenient time, the waste tank oil is emptied of the accumulated waste oil.

An aerator is attached to the rear of the enclosure with tubes extending into and around the bottom of each compartment. The aerator flows air into the compartments to aerate the cleaning solutions. The aerator on the rear of the enclosure is located above the rear wall of the stepped waste tank.

A control enclosure is also attached to the rear of the parts washer above the waste tank. An immersion heater extends from the control enclosure into the first compartment. The immersion heater heats the solution in the first compartment to a desired temperature for efficient washing. The heated solution heats the common wall between the compartments which, in turn, heats the solution in the second compartment. The common wall is constructed of a conductive material, such as metal, to promote efficient flow of the heat from the solution in the first compartment to the solution in the second compartment. The other three sides and bottom of each compartment are insulated to prevent heat loss.

The parts washer is positioned adjacent a milling machine and permits efficient washing of freshly machined parts by the same operator who runs the milling machine. Washing is performed during the interval between completion of milling of one part and completion of milling of the next part. In this way, labor costs are reduced.

Additionally, the storage and waste tanks in the washer permit relatively long-term use of the washer adjacent the milling machine. The storage tank holds a large volume of washing solution which is easily transferred to the washing compartments to replace evaporative loss of washing solution. The evaporative loss is reduced by closing the cover over the compartments when the washer is not in use. The waste tank holds a large volume of oil.

The back of the washer has a stepped configuration with the lower portion of the back wall located rearwardly of the rest of the back wall. Controls, including the control for the heater, an aerator control and drain pipes for oil skimmers, are all located at the back of the washer above the rear wall of the oil tank, which protects these components from injury on the shop floor.

Other objects and features of the invention will become apparent as the description proceeds, especially when taken in conjunction with the accompanying drawings illustrating the invention, of which there are five sheets and one embodiment.

DESCRIPTION OF THE PREFERRED EMBODIMENT

Parts washer 10 includes an outer enclosure or body 12, and first and second adjacent rectangular compartments 14 and 16 in the body. Both compartments are open at the top of the washer.

Figure 5:
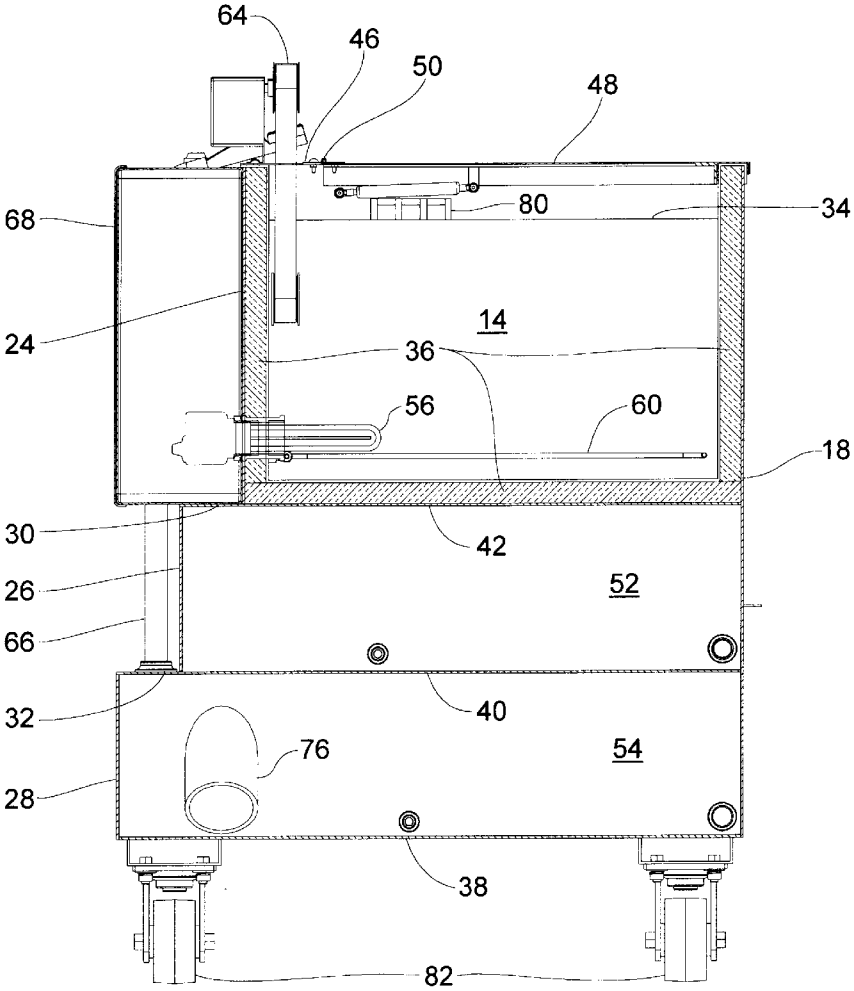
FIG. 5 is a sectional side view of the parts washer taken generally along line 5—5 of FIG. 4.

Body 12 includes a vertical front wall 18, vertical end walls 20 and 22 and a stepped rear wall including upper vertical wall portion 24, middle vertical wall portion 26, and lower vertical wall portion 28. As shown in FIG. 5, portion 26 is located rearwardly of portion 24 and portion 28 is located rearwardly of portion 26. Portions 24 and 26 are joined by horizontal top step 30, and portions 26 and 28 are joined by horizontal bottom step 32. The two compartments 14 and 16 extend between front wall 18 and top back wall portion 24. A common heat-transmitting metal wall 34, which is preferably made from a steel plate, separates compartments 14 and 16. Wall 34 is located equidistant between the end walls 20 and 22. Each compartment extends from wall 34 to an end wall and is generally square in horizontal section. Thermal insulation layers 36 are provided on the front back and sidewalls of compartments 14 and 16 to prevent heat loss from heated solution in the compartments. Thermal insulation is not provided on common wall 34.

Horizontal rectangular wall 38 is located at the bottom of body 12 and extends between the front wall 18 and back wall portion 28 and the two end walls. Horizontal wall 40 is spaced a distance above wall 38 and, likewise, extends between the front wall, back wall portion 28 and the end walls. Step 32 is a portion of wall 40. Top horizontal wall 42 is located above wall 40 and extends between front wall 18 and back wall portion 26 and between the end walls. Top step 30 is part of wall 42.

An elongate mounting plate 46 is joined to the top of end walls 20 and 22 and to the top of back wall portion 24 and extends along the length of the body above compartments 14 and 16. Cover or lid 48 is secured to plate 46 by elongate hinge 50 shown in FIGS. 1 and 5. The cover is moveable between a closed position shown in FIG. 5 where it covers the compartments 14 and 16 to an open position in which the lid is vertical and the compartments are open and available for washing of parts, as will be described hereinafter.

The washer 10 includes a storage tank 52 and a rectangular waste tank 54 located below the storage tank. Both tanks are generally rectangular and extend the length of the washer. The storage tank 52 is below the first and second compartments. Storage tank 52 extends between front wall 18 and rear wall portion 26, the end walls and horizontal walls 40 and 42. The waste tank 54 is below the storage tank and extends between the front wall 18, rear wall portion 28, the end walls and horizontal walls 38 and 40.

The rear of washer 10 has a step-like profile with wall portion 28 of tank 54 located rearwardly of portion 26 and portion 26 located rearwardly of portion 24.

A resistance immersion heater 56 extends into the first compartment 14 from back wall portion 24, slightly above the bottom of the compartment. The heater maintains the temperature of the solution in compartment 14 at a temperature of about 115° F. The heated solution facilitates washing of cutting oil from machined parts.

An air controller or pump 58 is mounted on the back wall portion 24 and flows air into distribution tubes 60 and 62 extending around the circumferences of compartments 14 and 16 at the bottoms of the compartments. Air bubbles out from tubes 60 and 62 and rises through the solutions in the compartments to oxidize organic matter in the solution. The air bubbles mix the solution, moves oil on the surface of the solution to the sides of the tank and aids in removing oil from machined parts. Additionally, the bubbles circulate the solutions past the heater 56 and along both sides of the common wall 34 to facilitate efficient heating of the solution in compartment 14, heat transfer to the common wall 34 and heating of the solution in compartment 16 by heated wall 34.

A pair of conventional belt skimmers 64 are mounted on the back wall portion 24 and extend through plate 46 a distance into the heated washing solution in each compartment. The skimmers remove cutting oil which collects on the top of the solutions in the compartments and delivers the cutting oil to drain pipes 66 which extend down the back of the washer past wall portion 26, through step 32 and into waste tank 54. The pipes 66 are located inwardly from the rear wall portion 28.

A control box 68 is mounted on the rear wall portion 24 and contains controls required to operate the oil skimmers, aerator, and heater. The rear wall of box 68 is located above the rear wall portion 28.

Transparent tube level indicators 70 and 72 are mounted on end wall 20 and open into the bottom of the storage tank 52 and waste tank 54, respectively. The indicators permit an operator to visually determine the amount of cleaning solution in tank 52 and the amount of oil in tank 54.

A fill valve or faucet 74 is mounted on end 20 of the washer and communicates with the bottom of storage tank 52. Opening of the valve permits filling of a bucket or other container located below the valve with new washing solution to replenish solution in compartments 14 and 16. Sump tube 76 extends through end wall 20 and into the bottom of waste tank 54 to facilitate removal of cutting oil collected by skimmers 64 and flowed into the waste tank. Fill port 78 extends upwardly from step 30 at the top of storage tank 52 to permit filling the tank with clean washing solution. Drain plugs are provided in both tanks.

Figure 1:
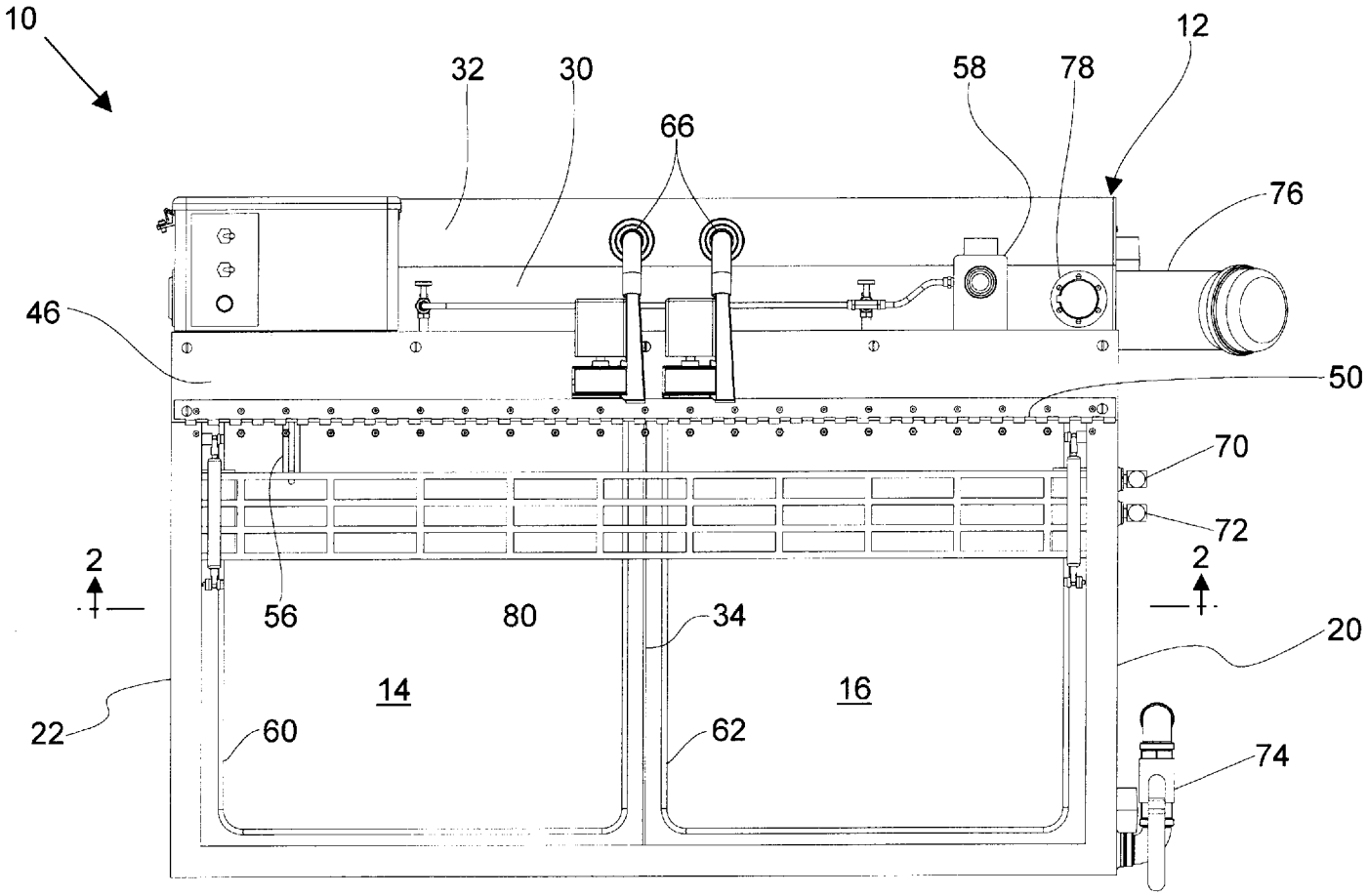
FIG. 1 is a top view of a parts washer according to the invention with the cover broken away.
Figure 2:
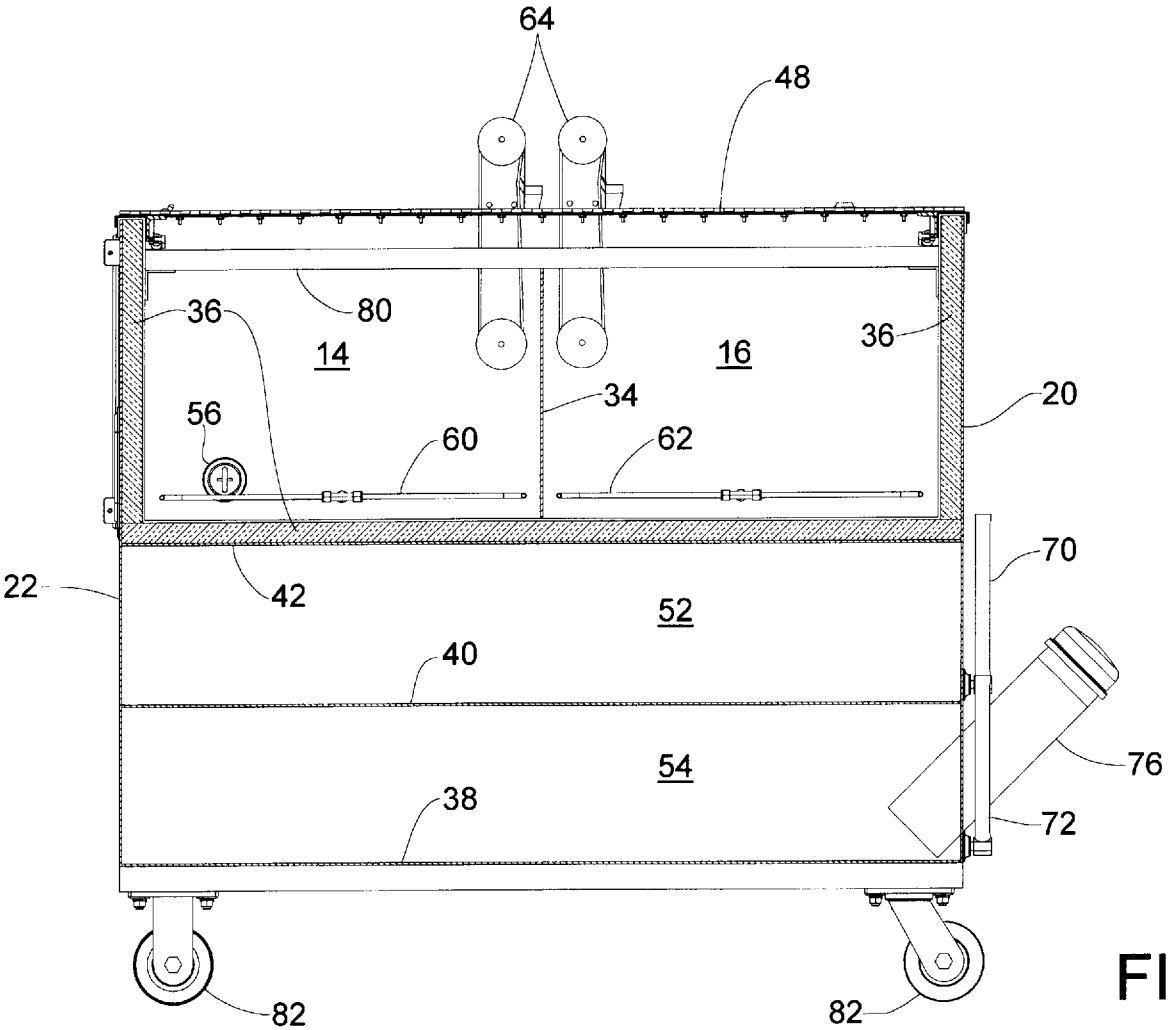
FIG. 2 is a sectional front view of the parts washer taken generally along line 2—2 of FIG. 1.
Figure 3:
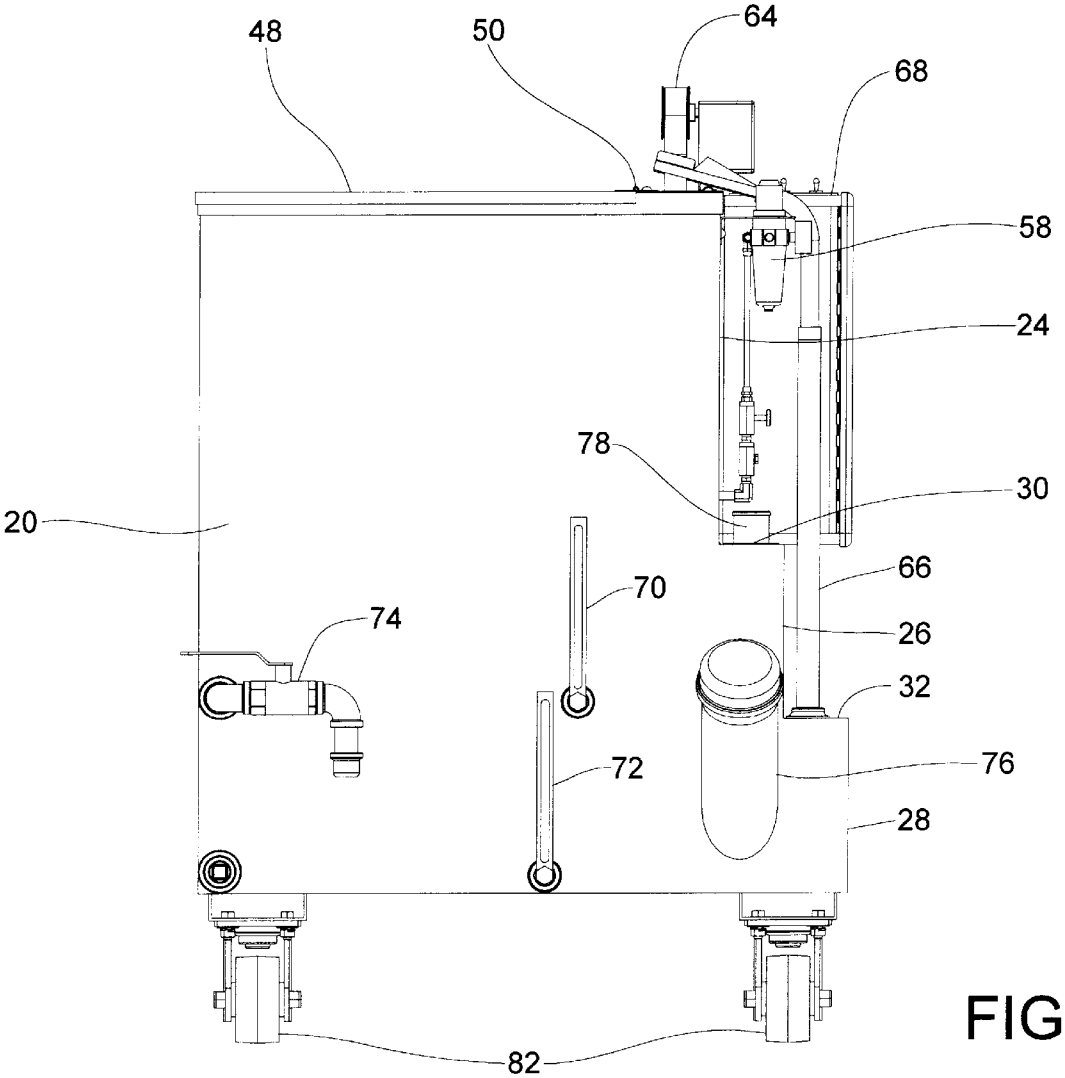
FIG. 3 is a side view of the parts washer according to the invention.
Figure 4:
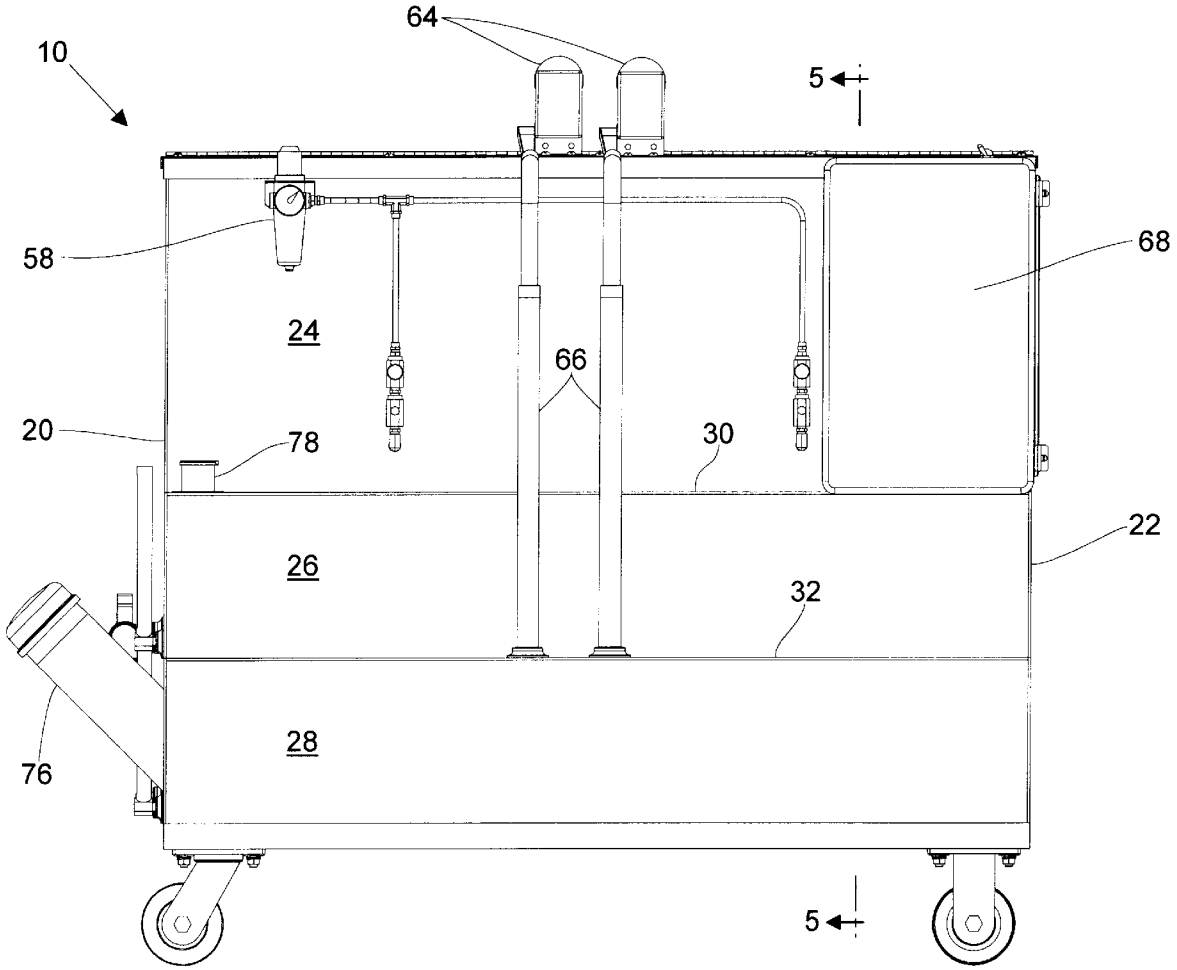
FIG. 4 is a rear view of the parts washer.

A drain rack 80 is mounted on the end walls of compartments 14 and 16 and extends over common wall 34 as illustrated in FIGS. 1, 2 and 5. Washed machined parts are placed on rack 80 to permit draining of washing solution from the parts back into the compartments.

The parts washer 10 is about 40 inches high. The compartments 14 and 16 have a width and horizontal depth of about 20 and 22 inches, respectively, and a vertical depth of about 12 inches. The height of the washer above the shop floor and size of the compartments facilitates manual washing of freshly machined parts in compartments 14 and 16 to remove cutting oil. Rack 80 extends above the top of compartments 14 and 16 a distance away from the back of the compartments. Heater 56 extends into compartment 14 from the back wall of the compartment at the bottom of the compartment. The rack limits the space in compartment 14 available for washing to the front portion of the compartment so that the machined part is kept away from the heater.

Prior to use of parts washer 10, the compartments 14 and 16 are filled with washing solution to an appropriate level and the heater and aerator are activated at the control box. Heater 56 is controlled to maintain the temperature of the solution in compartment 14 at about 115° F. Heating of the solution in compartment 14 is facilitated by the upward flow of bubbles from the bubbler tube 60 so that the solution is uniformly heated and also heats the common wall 34 between compartments 14 and 16. Heated wall 34 heats the solution in compartment 16, which is circulated by bubbles flowing upwardly from tube 62. After initial start-up, heater 56 maintains the temperature of the solution in compartment 14 at about 115° F. and also maintains a temperature of the solution in compartment 16 at a level only a few degrees less than the solution in compartment 14. The insulation 36 surrounding the sides and bottoms of the compartments reduces heat loss to maintain the solutions in the two compartments at a desired temperature suitable for removing oil from machined parts. During initial heating of the two solutions, cover 48 may be closed as shown in FIGS. 2–5 to prevent heat loss. The cover does not tightly seal against the top of the body and permits escape of air bubbled up from the tubes 60 and 62.

Prior to placing parts washer 10 in production to clean machined parts, tank 52 is filled with clean wash solution. At the same time, waste tank 54 is emptied of oil which was previously collected by the skimmers and drained down into the tank.

Rollers 82 mounted on the bottom of the body permit ready movement of parts washer 10 on the shop floor to a work position adjacent a milling machine. The parts washer is self-contained and is made operational at the work position by connection to a source of compressed air (if required) and to the shop electrical system.

The work position of the washer is on the shop floor, where the washer is exposed to being bumped by normal shop traffic including transport dollies and lift trucks. The control box, air pump and aeration system, skimmers and drain pipes mounted on the back of the washer are exposed to permit adjustment and service of the washer. These parts are protected from injury by dollies, trucks and the like, by the back wall portion 28 of the waste tank, which is located at the back of the washer, as shown in FIG. 5. This wall extends above the floor level to a height of about 15 inches to protect the controls and components mounted on the back of the washer above the waste tank.

The parts washer is positioned adjacent a milling machine at a location where a freshly machined part may be thoroughly washed in both compartments and then placed on the rack to drain during the interval when the milling machine is machining the next part. In this way, one operator can supply parts to be machined to the milling machine, remove the machined parts, which are then covered by cutting oil, wash the freshly machined parts in both compartments to remove the machine oil and coat the parts with an anti-rusting agent and then place the parts on the rack to drain. After draining, the cleaned and coated machined parts are removed and used, placed in inventory or shipped, as desired.

During machining, cutting oil is applied to the parts to facilitate milling or boring. After the machining operation has been completed, the operator manually removes a freshly machined part from the milling machine, positions a new part on the machine to be milled and manually places the machined part in compartment 14. The operator preferably wears protective gloves during handling and washing of parts. The operator manually moves a gloved hand along the surfaces of the immersed machined part to remove cutting oil. If necessary, an appropriate brush or cloth may be used to facilitate washing of the part. Initial washing in compartment 14 removes practically all cutting oil from the part.

After initial washing, the part is removed from compartment 14 and immersed into compartment 16 where washing continues, as previously described. Washing in the second compartment 16 assures that all cutting oil is removed from the part. The solution in compartment 16 is cleaner than the solution in compartment 14 and results in a thorough, clean final wash. Immersion of the part into the solutions in compartments 14 and 16 coats the freshly machined surfaces of the part with a rust inhibitor to inhibit formation of rust on the part. After washing in compartment 16 is completed, the freshly washed and coated part is placed on rack 80 to drain. The operator is then free to service the milling machine by removing the next milled part and loading a subsequent part to be milled. The removed milled part is then washed as previously described. After the washed parts have drained for a suitable interval, they are placed on a collection tray and removed.

During use of parts washer 10, washing solution is lost from compartments 14 and 16. The lost solution is easily replenished by the operator by flowing additional clean washing solution from tank 52 into a bucket and refilling the compartment, as appropriate. There is no need to secure additional solution from a remote source. Heater 56 rapidly reheats the solution in the compartments to the desired operating temperature.

During operation of the parts washer, skimmers 64 remove cutting oil which collects at the top of the solutions in the compartments. This oil is flowed down to and collects in the waste tank 54. The two level indicators 70 and 72 permit the operator to monitor the amount of clean washing solution remaining in the storage tank and the amount of waste cutting oil and solution removed with the cutting oil in waste tank 54.

Additional cleaning solution is added to tank 52, as required. The waste tank is pumped out as required. The tanks 52 and 54 have relatively large capacities and permit operation of washer 10 for a long period of time without the necessity of supplying additional solution or pumping the waste tank.

During periods when the milling machine is not in operation, it is desirable to close lid 48 to reduce evaporative loss of washing solution. During long periods of inactivity, it may be desirable to deactivate the washer.

While I have illustrated and described a preferred embodiment of my invention, it is understood that this is capable of modification and I, therefore, do not wish to be limited to the precise details set forth, but desire to avail myself of such changes and alterations as fall within the purview of the following claims.

What I claim as my invention is:

1. A parts washer for removing cutting oil from machined parts, said washer including:

a) a pair of side-by-side open wash compartments;

b) a heater for heating wash solution;

c) a washing solution storage tank located below the compartments with a discharge valve for gravity draining of wash solution from such tank;

d) a waste storage tank located below the solution storage tank; and e) a pair of oil skimmers, each skimmer extending into one compartment for removing cutting oil collected on the top of washing solution in such compartment, and a drain system extending from the skimmers to the storage tank for draining collected cutting oil into the storage tank.

2. A parts washer as in claim 1 including a plurality of support rollers.

3. A parts washer as in claim 2 including controls for the washer mounted on the back of the washer above the waste storage tank.

4. A parts washer as in claim 3 wherein the back of the washer is stepped and includes a lower vertical wall portion at the back of the waste tank, a middle vertical wall portion at the back of the washing solution storage tank, a top vertical wall portion at the back of the compartments, and upwardly facing steps between said lower and middle vertical wall portions and said middle and upper vertical wall portions.

5. A parts washer as in claim 2 including a cover overlying the top of the compartments when closed, a mounting member on the back of the washer above the compartments and a hinge joining the cover to the mounting member, said skimmers extending through said mounting member.

6. A parts washer as in claim 5 including a drainage rack above the compartments, said rack located under the cover when closed.

7. A parts washer as in claim 2 wherein said heater comprises a single heating element in only one compartment and a heat conducting wall between the compartments.

8. A parts washer as in claim 7 wherein said wall comprises a metal plate with one side of the plate exposed to one of the compartments and the other side of the plate exposed to the other of the compartments.

9. A parts washer as in claim 8 including thermal insulation surrounding the compartments away from the plate.

10. A parts washer for removing cutting oil from machined parts, said washer including:

a) first and second side-by-side open washing compartments having a common heat-conducting wall between the compartments; and b) a heater in said first compartment only, said heater operable to heat washing solution in the first compartment to a washing temperature and to heat washing solution in the second compartment to a washing temperature by thermal conduction through said wall.

11. A parts washer as in claim 10 including a wash solution tank located below the compartments and a valve for discharge wash solution from such tank; and a waste storage tank.

12. A parts washer as in claim 11 wherein said wash solution tank is located immediately below the compartments and said waste storage tank is located immediately below the wash solution tank.

13. A parts washer as in claim 12 wherein said waste storage tank extends to the rear of the washer beyond said compartments and said solution tank, and including controls for the washer mounted on the washer above the waste storage tank.

14. A parts washer as in claim 13 including a pair of oil skimmers, each skimmer mounted on the washer above one of the compartments and extending into the compartment, and a drain pipe extending from the skimmers to the waste storage tank.

15. A parts washer as in claim 13 wherein said wall comprises a metal plate forming one side of each of the compartments and including a drainage rack above the compartments and a cover for the compartments.

16. A parts washer as in claim 15 including a plurality of support rollers.

17. A parts washer as in claim 16 including an air source and a pair of air distribution tubes connected to the source, each tube located at the bottom of one of the compartments for flowing bubbles of air up through the wash solution in the compartment.

18. A parts washer for moving cutting oil from machined parts, said washer including:

a) a pair of side-by-side open washing compartments at the top of the washer;

b) a heater for heating wash solution in a compartment;

c) a wash solution storage tank located below the compartments;

d) a waste storage tank located below the wash storage tank; and e) the back of the washer having a stepped configuration including a lower wall portion at the back of the waste tank, a middle wall portion at the back of the storage tank, a top wall portion at the back of the compartments, a first upwardly facing step between said lower and middle wall portions, and a second upwardly facing step between said middle and upper wall portions.

19. A parts washer as in claim 18 including a pair of oil skimmers, each skimmer located above and extending into one of the compartments and an oil drain system extending from the skimmers to the first step between the lower and middle wall portions and a control for said heater, said drain system and said control being located above said first step.

20. A parts washer as in claim 18 including a drain rack over the compartments, said rack located between the front of the compartments and the heater.

* * * * *

UNITED STATES PATENT AND TRADEMARK OFFICE

CERTIFICATE OF CORRECTION

PATENT NO. : 5,845,661

DATED : December 8, 1998

INVENTOR(S) : Allen W. Leppo

It is certified that error appears in the above-identified patent and that said Letters Patent is hereby corrected as shown below:

Claim 18, line 1, following "A parts washer for" change "moving" to --removing--.

Signed and Sealed this

Sixteenth Day of March, 1999

*Attest:*

Q. TODD DICKINSON

*Attesting Officer*

*Acting Commissioner of Patents and Trademarks*